United States Patent [19]

Pelham et al.

[11] 3,974,772

[45] Aug. 17, 1976

[54] ROCKET IGNITER

[75] Inventors: Joseph E. Pelham, Huntsville, Ala.; Frank W. La Haye, Hollister, Calif.

[73] Assignee: Thiokol Corporation, Newtown, Pa.

[22] Filed: June 25, 1958

[21] Appl. No.: 745,799

[52] U.S. Cl. ..... 102/70.2 A; 102/49.7; 60/256

[51] Int. Cl.[2] ..... F42B 5/08

[58] Field of Search ..... 60/35.6, 256; 102/49, 102/70.2, 49.7

[56] References Cited

UNITED STATES PATENTS

| | | | |
|---|---|---|---|
| 2,462,135 | 2/1949 | Skinner | 102/49 X |
| 2,561,670 | 7/1951 | Miller | 102/49 UX |
| 2,776,623 | 1/1957 | Bonner | 102/49 |

OTHER PUBLICATIONS 2,627,160 MacDonald "Rocket Propulsion Elements" by George P. Sutton, Published by John Wiley and Sons, Inc. 1956 Second Edition, pp. 364–365.

*Primary Examiner*—Samuel Feinberg

EXEMPLARY CLAIM

1. An igniter adapted to be positioned in the convergent portion of the nozzle of a rocket engine, said igniter comprising, a tapered combustible plastic casing having a small end and a large end, said casing having a stepped recess therein comprising a large cavity formed in the large end of said casing and a relatively small cavity opening into the inner end of said large cavity, a squib including a primer charge positioned in said small cavity, a body of pyrotechnic material positioned in said large cavity adjacent to said primer charge, a closure disc positioned in said large cavity to hold said pyrotechnic material therein, and squib-activating means for igniting said primer charge, said activating means extending from said squib through said casing and out the small end thereof, the inner end of said small cavity and the small end of said casing being substantially spaced from one another to provide a substantial body of combustible plastic therebetween.

3 Claims, 3 Drawing Figures

ROCKET IGNITER

This invention relates to the ignition of solid propellant rocket engines and more particularly to an improved igniter especially adapted to be used in a rocket engine that is to be incorporated in an air-to-air missile.

Solid propellant rocket engines commonly comprise an essentially closed cylindrical casing having a hollow propellant charge, commonly called a propellant grain, cast therein. At one end the casing is provided with a nozzle through which hot gases evolved by combustion of the propellant charge pass to produce the motive impulse which drives the rocket. The rocket engine also includes an igniter designed and positioned to throw a flame into the interior of the hollow propellant grain to ignite it. The igniter may be placed either in the anterior portion of the combustion chamber of the engine or in the convergent portion of the nozzle. When the igniter is placed in the anterior portion of the rocket engine, difficulties are encountered because the igniter takes up space that otherwise could be filled with propellant and also because the lead wires from the igniter must be extended through the full length of the rocket engine. On the other hand when the igniter is placed in the nozzle portion of the rocket engine difficulties have been encountered because of inability to direct the flame far enough forward to cause reliable ignition of the propellant.

In order to secure a desired uni-directional propagation of the igniting flame it is necessary to block the nozzle orifice temporarily, but it is also important that the blocking means be removed at the proper time to prevent an excessive build-up of pressure within the combustion chamber. The nozzle closure types of igniters previously used have been of the metal plug type wherein the nozzle orifice is closed by a metal member held in place by pins or bolts that are designed to shear off when the combustion chamber pressure reaches a predetermined point. Thereafter, the metal closure is ejected through the tail of the rocket by the combustion gases. Igniters of this type cause difficulties when incorporated in air-to-air missiles since the ejection of the nozzle-blocking member produces harmful debris which may be left in the launching chamber or hurled out against other parts of the aeroplane or other launching vehicle.

It is accordingly an object of the present invention to provide an improved igniter for a solid propellant rocket engine which is composed essentially completely of combustible materials that burn without leaving any harmful debris. It is another object of the invention to provide an igniter that produces the desired uni-directional flame propagation into the interior of the propellant grain to assure rapid ignition of the entire interior surface of the propellant charge without development of excessive combustion chamber pressures. Other objects of the invention will be in part obvious and in part pointed out hereafter.

The objects of the present invention are achieved in general by utilizing a nozzle closure igniter essentially composed of plastic which is located in the aft portion of the rocket and is shaped to fit into the convergent portion of the nozzle of the rocket. The casing of the igniter is molded from a suitable plastic, e.g. a thermosetting, heat-resistant, rigid, foamed plastic, and the casing is recessed to receive an ignition train. A relatively thick aft section of the casing serves as a nozzle closure, and by momentarily blocking the nozzle orifice, it directs the action of the igniter forward into the propellant burning chamber. The igniter is made almost wholly of combustible materials, and hence in operation it forms no harmful debris.

The many objects and advantages of the present invention may be best understood and appreciated by referring to the accompanying drawing which illustrates a rocket engine incorporating a preferred embodiment of the invention and wherein.

Figure 1:
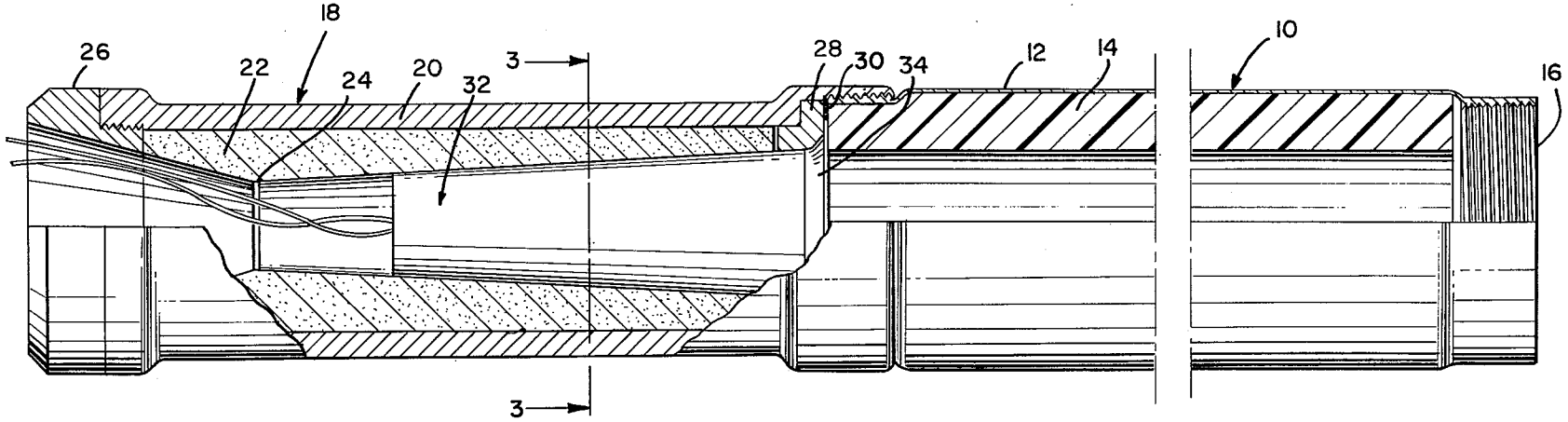
FIG. 1 is a side view of a rocket engine, primarily a side view of the tail portion of the rocket engine, broken away to show the relative locations of the nozzle, the igniter and the rear end of the propellant charge.

Referring to the drawing and more particularly to FIG. 1 the rocket engine there shown comprises a main combustion chamber 10 comprising a thin-walled cylindrical metal casing 12 having a hollow cylindrical propellant grain 14 cast therein. At its forward (right-hand) end casing 12 is provided with threads 16 by means of which it may be attached to a missile or the like.

Threaded on to the rear of casing 12 there is a nozzle assembly generally designated 18 which comprises a metal sleeve 20 having therein a carbon insert 22 with converging and diverging portions that cooperate to define a nozzle throat 24. The carbon insert 22 is held in place at its left end by a ring closure 26 threaded into the left end of sleeve 18 and at its right end by a spacer ring 28 which bears, through gasket 30, against the left end of casing 12 and of propellant grain 14.

Located within the converging portion of nozzle insert 22 there is an igniter 32 which is tapered to conform with the taper of the nozzle insert and is held in place by a ring 34 interposed between the right end of the igniter 32 and the propellant grain 14.

Figure 2:
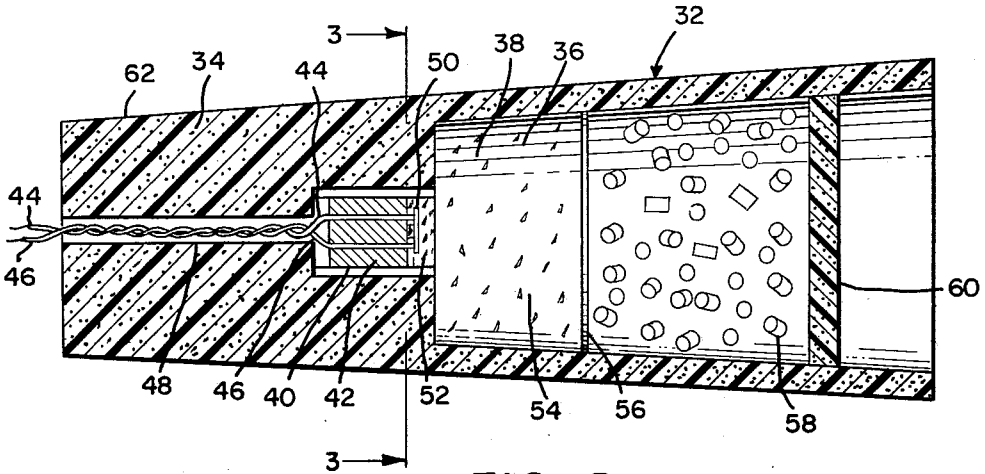
FIG. 2 is a central longitudinal section through the igniter showing the ignition train therein.
Figure 3:
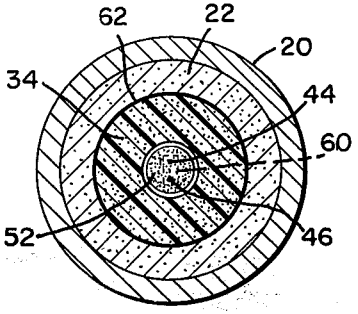
FIG. 3 is a transverse section taken on the lines 3—3 of FIGS. 1 and 2, showing portions of the squib and the compartment containing the primer charge.

The details of igniter 32 are best shown in FIG. 2 of the drawing. Referring to FIG. 2 the igniter comprises a tapered casing 34 which as pointed out above is preferably made of a suitable thermosetting plastic such as for example a conventional polyurethane foamed plastic. Formed in the larger end of tapered casing 34 there is a deep recess 36 which may be characterized as a stepped recess since it comprises a relatively large diameter cavity 38 which merges at its inner end into a small diameter cavity 40.

The recess 36 contains an ignition train comprising in series a squib, a primer charge, a booster charge and a main ignition charge. More particularly, the recess 40 contains a squib 42 having the electrical leads 44 and 46 which extend to the left through a passage 48 in the plastic casing 34 and outwardly from the left end of the igniter. At their right end the leads 44 and 46 are connected to a bridge wire 50, which may be a nichrome resistance wire for example, and which is embedded in a primer charge 52. The primer charge 52 may be any readily ignitable material such as black powder.

Positioned immediately adjacent to the primer charge 52 and in the large diameter cavity 38 there is a booster charge 54 that is held in place by a separator disc 56 positioned in the cavity 38 with a press fit. To the right of disc 56 within cavity 38 is the main ignition charge 58 which is confined between the separator disc 56 on one side and a closure disc 60 on its other side. The compositions of the booster charge 54 and main ignition charge 58 form no part of the present invention and any suitable conventional and well known pyrotechnic compositions may be used for this purpose. For example, the booster charge 54 may be a comminuted material having granules composed of 82% to 84% by weight potassium perchlorate, 9% to 13% elemental boron and 5% to 7% polyisobutylene. The main igniter charge may comprise pellets of a material composed of 65% to 75% by weight potassium nitrate, 21% to 26% elemental boron and 4% to 9% of a polyester resin binder.

In order to protect the igniter against moisture the entire igniting unit 32 is preferably coated with a thin layer of plastic 62. This moisture-proof coating can be conveniently applied by dipping the assembled unit in a standard commercial liquid epoxy resin sealing composition and curing the coating on the unit to provide a moisture-proof seal.

The mode of operation of the present igniter should be apparent from the foregoing description. When it is desired to fire the rocket, electrical energy is supplied through the leads 44 and 46 to the squib 42 and more particularly to the bridge wire 50. The wire 50 is thereby heated to a temperature sufficient to ignite the primer 52 which in turn ignites the booster charge 54 and the main ignition charge 58, thereby causing a flame to be projected into the interior of the propellant charge 14 within the combustion chamber 10. It will be noted from FIG. 2 that the cavity 40 is spaced a substantial distance from the left end of the igniting unit, thereby providing a solid mass of plastic which temporarily blocks the nozzle orifice 24 and insures projection of the igniting flame in the desired direction. On the other hand this plastic mass burns up within a relatively short period of time to open the nozzle before excessive pressures have built up within the combustion chamber 10.

It should be noted that nearly all the components of the igniter are made of combustible materials which burn without forming any harmful debris. The leads 44 and 46 can be and desirably are made of very fine wire which can be ejected from the rocket without producing any harmful effect. Thus the present igniter performs its desired flame-directing function in an effective manner and then disintegrates substantially completely to open up the nozzle passage for escape of the rocket-propelling gases.

Since many embodiments of the present invention may be made and since many changes may be made in the specific embodiment described herein without departing from the spirit of the invention, the foregoing description is to be interpreted as illustrative only and not in a limiting sense.

We claim:

1. An igniter adapted to be positioned in the convergent portion of the nozzle of a rocket engine, said igniter comprising, a tapered combustible plastic casing having a small end and a large end, said casing having a stepped recess therein comprising a large cavity formed in the large end of said casing and a relatively small cavity opening into the inner end of said large cavity, a squib including a primer charge positioned in said small cavity, a body of pyrotechnic material positioned in said large cavity adjacent to said primer charge, a closure disc positioned in said large cavity to hold said pyrotechnic material therein, and squib-activating means for igniting said primer charge, said activating means extending from said squib through said casing and out the small end thereof, the inner end of said small cavity and the small end of said casing being substantially spaced from one another to provide a substantial body of combustible plastic therebetween.

2. An igniter adapted to be positioned in the convergent portion of the nozzle of a rocket engine, said igniter comprising a tapered combustible plastic casing having a small end and a large end, said casing having a stepped recess therein comprising a large cavity formed in the large end of said casing and a relatively small cavity opening into the inner end of said large cavity, an ignition train located in said recess and comprising a squib and primer charge positioned in said small cavity and a booster charge and main pyrotechnic charge positioned within said large cavity, and squib-activating means for igniting said ignition train, said activating means extending from said squib through said casing and out the small end thereof, the inner end of said small cavity and the small end of said casing being substantially spaced from one another to provide a substantial body of combustible plastic therebetween.

3. An igniter adapted to be positioned in the convergent portion of the nozzle of a rocket engine, said igniter comprising a frusto-conical combustible plastic casing having a small end and a large end, said casing having a stepped recess therein comprising a large cavity formed in the large end of said casing and a relatively small cavity opening into the inner end of said large cavity, an ignition train positioned in said recess and comprising a squib and primer charge positioned in said small cavity and a booster charge and main pyrotechnic charge positioned in said large cavity, a separator member mounted in said large cavity to separate said booster charge and main pyrotechnic charge, a closure member between said main charge and the large end of said casing, and a squib-activating means for igniting said ignition train, said activating means extending from said squib through said casing and out the small end thereof, the inner end of said small cavity and the small end of said casing being substantially spaced from one another to provide a substantial body of plastic combustible therebetween.

* * * * *